US006068144A

United States Patent [19]

Corpuz, Jr. et al.

[11] Patent Number: 6,068,144

[45] Date of Patent: May 30, 2000

[54] INFORMATION POSTING UNIT

[75] Inventors: Roque M. Corpuz, Jr.; Steven J. Beukema, both of Grand Rapids; Clarkson S. Thorp, Wayland, all of Mich.

[73] Assignee: Haworth, Inc., Holland, Mich.

[21] Appl. No.: 09/089,532

[22] Filed: Jun. 3, 1998

[51] Int. Cl.[7] ..... A47B 57/00; A47F 5/02

[52] U.S. Cl. ..... 211/205; 211/163

[58] Field of Search ..... 211/205, 196, 211/163, 13.1, 58, 54.1, 50

[56] References Cited

U.S. PATENT DOCUMENTS

| | | | |
|---|---|---|---|
| 1,754,998 | 4/1930 | Geartts | 211/205 X |
| 2,025,639 | 12/1935 | Bradford | 211/163 X |
| 3,307,707 | 3/1967 | Wright | 211/13.1 |
| 3,315,819 | 4/1967 | Kingsbery | 211/163 |
| 3,420,468 | 1/1969 | Rhoades | 211/59.1 X |
| 3,424,317 | 1/1969 | Singer | 211/196 X |
| 3,517,824 | 6/1970 | Paque | 211/50 |
| 3,759,377 | 9/1973 | Weimer | 211/59.1 X |
| 4,262,439 | 4/1981 | Dinan et al. | 211/187 X |
| 4,678,150 | 7/1987 | Newman et al. | 248/205.3 |
| 5,433,036 | 7/1995 | Ganal | 40/729 |
| 5,560,093 | 10/1996 | Hutton et al. | 29/432 |
| 5,697,684 | 12/1997 | Gyovai | 211/40 X |
| 5,839,586 | 11/1998 | Smith | 211/163 |

FOREIGN PATENT DOCUMENTS

| | | |
|---|---|---|
| 1 430 269 | 1/1966 | France . |
| 2 213 977 | 8/1989 | United Kingdom . |

*Primary Examiner*—Daniel P. Stodola
*Assistant Examiner*—Erica B. Harris
*Attorney, Agent, or Firm*—Flynn, Thiel, Boutell & Tanis, P.C.

[57] ABSTRACT

A freestanding, mobile information posting unit for use in the workplace or other environment including a base and a rod extending upwardly therefrom. A plurality of posting members are arranged in a generally vertical manner on the rod for posting information thereon. The posting members are individually rotatable about the rod. The shape of the posting members, and their positional arrangement on the rod, allows the peripheral surfaces of adjacent posting members to be disposed in nonaligned relation to accommodate attachment of notes and the like thereon.

15 Claims, 6 Drawing Sheets

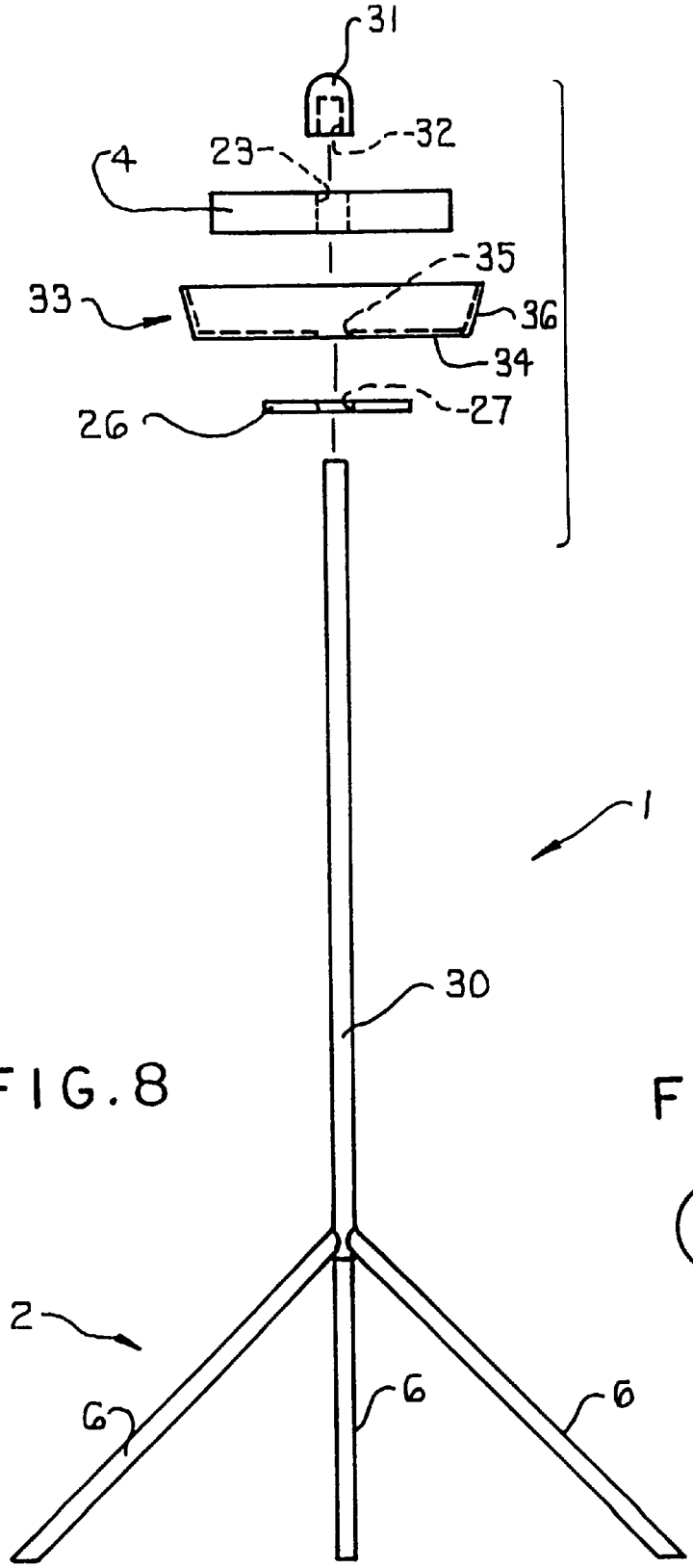
FIG. 8
FIG. 9
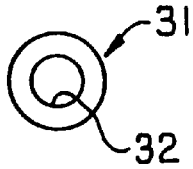

INFORMATION POSTING UNIT

FIELD OF THE INVENTION

This invention relates to an information or message posting unit such as is typically used in an office setting and, more particularly, to a posting unit which is freestanding and movable to any desired location in the workplace or other environment.

BACKGROUND OF THE INVENTION

Information posting units are extensively utilized in office environments, and also in the home, and numerous variations of such arrangements have been developed. Conventional posting units include what are commonly called "bulletin boards" which typically include a flat rigid frame including thereon a layer of cork or other deformable material capable of gripping tacks, pins or other fasteners for holding papers thereon. However, units of this type are most often adapted for wall mounting and thus are not easily movable to different locations in the workplace. In addition, only the outwardly facing surface is usable for displaying information.

SUMMARY OF THE INVENTION

It is an object of the invention to provide an information posting unit, and more particularly a freestanding mobile information posting unit which is viewable from virtually any vantage point in the workplace. The posting unit of the invention is particularly suited for open-space office environments for dissemination of information to a group of people.

More specifically, the information posting unit incorporates a support base and a rod which extends vertically upwardly therefrom. A plurality of posting members are disposed generally vertically along the rod in a stacked manner and have peripheral edge surfaces which permit attachment of informational notes and the like.

In a preferred embodiment, each posting member includes at least a wall portion of a puncturable and deformable material capable of releasably gripping a fastener having a sharp end, such as a tack.

The posting members each have a hole therethrough through which the rod extends. The posting members are preferably disc-shaped and the holes thereof are located eccentrically with respect to the outer periphery of each disc to enable rotation of the posting members about the rod into positions wherein the peripheries of the discs are out of alignment with one another. Thus, information can be easily posted on the outer periphery of a posting member which projects further in the horizontal direction than an adjacent posting member, or on the exposed underside of the posting member. A clamping member holds the posting members in the non-aligned positions.

In one embodiment, a tray is located underneath a lowermost one of the posting members for storing objects such as tacks, pins or other fasteners.

Other objects and purposes of the invention will be apparent to persons familiar with devices of this type upon reading the following specification and inspecting the accompanying drawings.

BRIEF DESCRIPTION OF THE DRAWINGS

FIG. 8 is an exploded side view thereof; and

FIG. 9 is an enlarged bottom view of the clamping member thereof.

Figure 1:
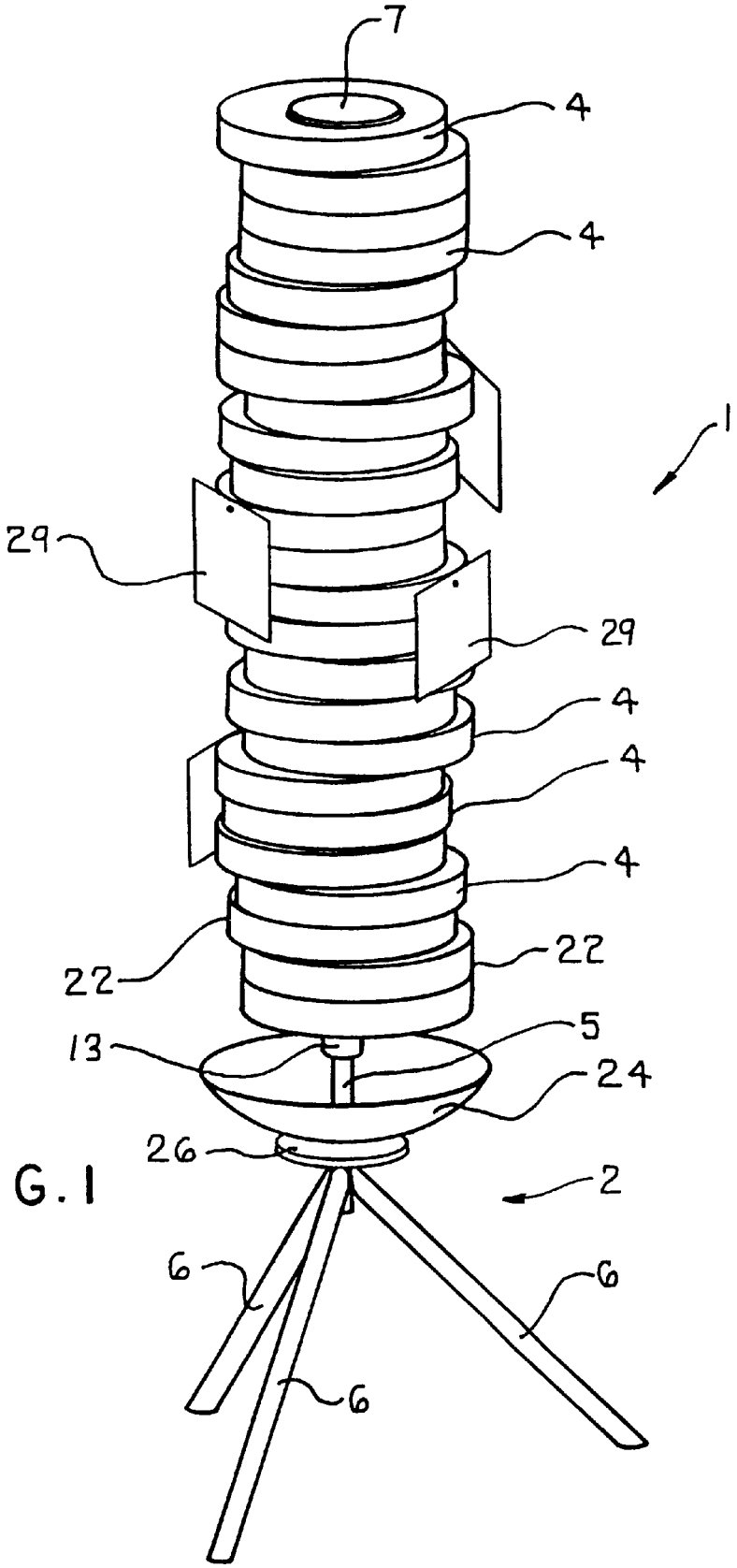
FIG. 1 is a perspective view of a first embodiment of the information posting unit according to the present invention.
Figure 2:
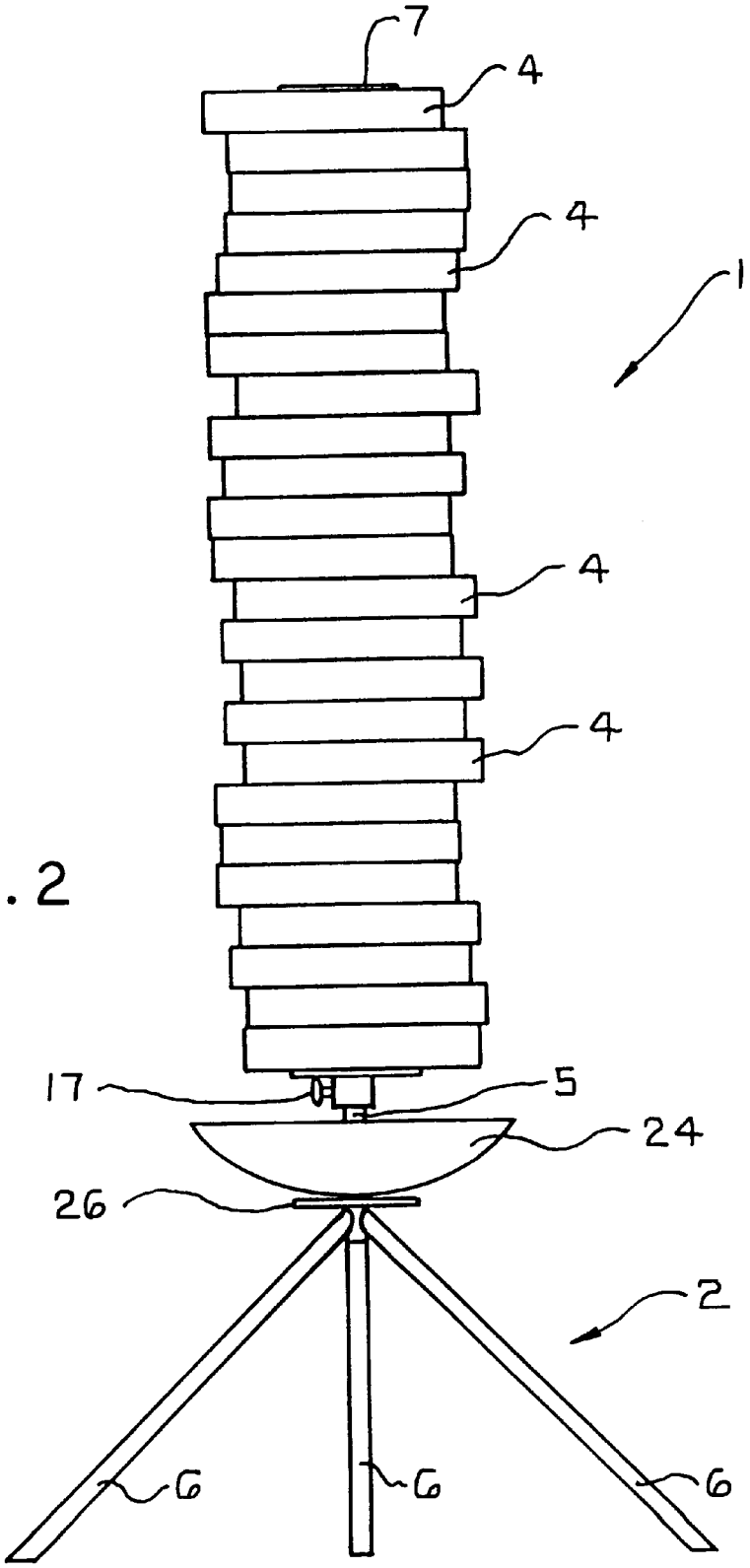
FIG. 2 is a side view thereof.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIGS. 1–6, the invention relates to an information posting unit 1 including a base 2, a support tube 3 which extends in a vertical manner upwardly from the base 2, and a plurality of posting members 4 disposed along the tube 3 so as to form a stack.

The base 2, in a preferred embodiment, includes an elongated cylindrical post 5, and three elongated cylindrical legs 6 fixedly attached to a bottom end of the post 5. The legs 6 angle outwardly and downwardly from the post 5 and are spaced at approximately equal distances from one another (i.e. at about 120° from one another) so as to form a stable support for the posting unit 1 when placed on a horizontal surface such as a floor.

The tube 3 preferably has an inner diameter of a size sufficient to permit same to telescopingly slide over the base post 5. A generally circular upper plate 7 is fixedly attached at the upper end of tube 3. The underside of the plate 7, in the assembled state of the posting unit 1, abuts the uppermost posting member 4 and serves as an upper stop for the stack of posting members 4.

Figure 4:
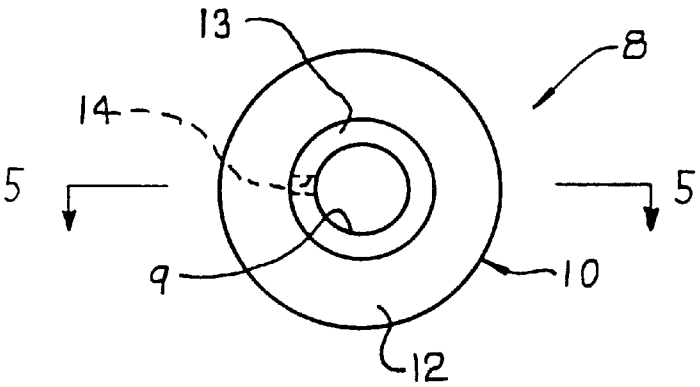
FIG. 4 is an enlarged bottom view of the clamping member.
Figure 6:
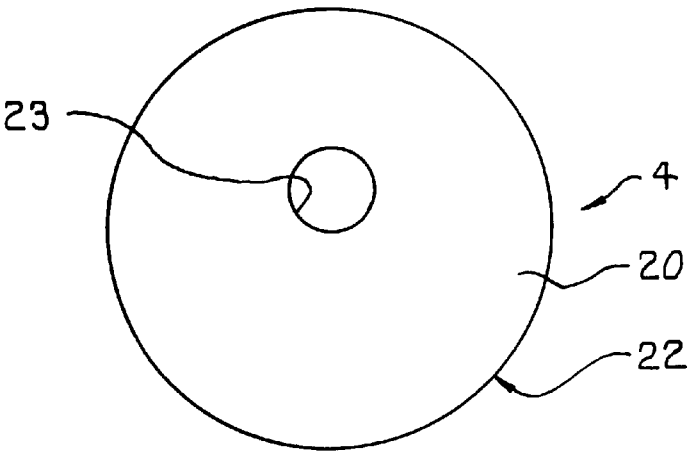
FIG. 6 is an enlarged plan view of a posting member.
Figure 5:
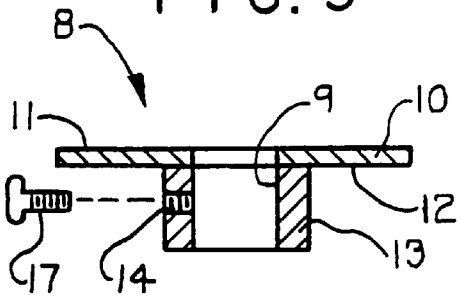
FIG. 5 is a cross-sectional view of the clamping member taken generally along line 5—5 of FIG. 4.

A clamping member 8 (as best shown in FIGS. 4 and 5) having a centrally located through hole 9 is disposed about the lower end of the tube 3. The through hole 9 is of a size sufficient to permit sliding axial movement of the clamping member 8 along the outer surface of the tube 3 (i.e. the diameter of through hole 9 is slightly larger than the outer diameter of tube 3) for a purpose discussed in further detail below. The clamping member 8 is embodied by a generally circular plate-like portion 10 having oppositely facing upper and lower planar surfaces 11 and 12, and a tubular base 13 which extends downwardly from the lower surface 12 of the plate-like portion 10. The through hole 9 of the clamping member 8 is defined through each of the plate-like portion 10 and the tubular base 13.

Figure 3:
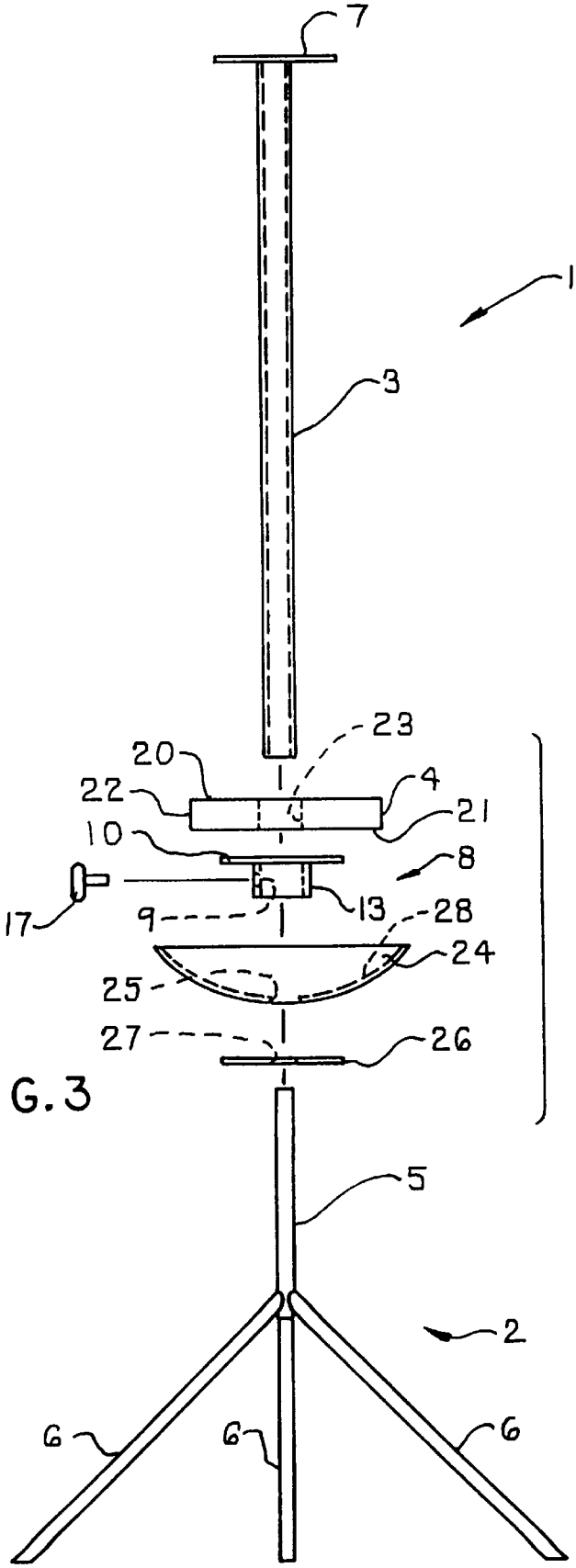
FIG. 3 is an exploded side view thereof.

The tubular base 13 includes a bore 14 which extends therethrough in a generally perpendicular direction with respect to the axis of the through hole 9. The bore 14 has internal threads for engaging with external threads of a set screw 17 (FIG. 3). When the clamping member 8 is disposed about the lower end of the tube 3, the set screw 17 is turnable inwardly until the leading end of the set screw 17 abuts against the outer surface of the lower end of the tube 3. An opposite turning of the set screw 17 causes same to move away from and out of contact with the tube 3 to enable axial movement of the clamping member 8 with respect to the tube 3 for a purpose as discussed below.

The posting members 4 are preferably identical to one another and therefore only one such posting member 4 will be described. The posting member 4 (FIGS. 3 and 6) is preferably embodied by a circular disc having oppositely disposed upper and lower planar surfaces 20 and 21, and a peripheral edge surface 22 adjoining the end surfaces 20 and 21. The peripheral surface 22 is cylindrical in the preferred embodiment of the posting member 4. The posting member 4 also includes a hole 23 extending therethrough between surfaces 20 and 21. The hole 23 is preferably disposed eccentrically with respect to the cylindrical peripheral edge surface 22.

In a preferred embodiment, each posting member 4 is preferably constructed of a rigid foam, for example Styrofoam®. However, another material may be used, so long as the material is puncturable and capable of resiliently and releasably gripping a fastener inserted therein, for example, cork.

A tray 24 having a central hole 25 through a bottom thereof is preferably located atop base 2, adjacent the upper ends of the legs 6 for conveniently storing objects such as tacks, pins, etc. usable with the posting unit 1. The tray 24 is preferably made of plastic. The tray 24 is shown here as generally having a bowl-shape, but may have any desired configuration and should generally be larger in diameter or width as compared to the diameter of the posting members 4 to provide easy access to the objects stored therein.

The tray 24 can be supported axially on the base 2 by means of the diverging upper ends of the base legs 6, or alternatively, a generally circular plate 26 having a central hole 27 (FIG. 3) may be provided about the base post 5 so as to rest atop the upper ends of the base legs 6 for supporting the tray 24. The plate 26 may be fixedly attached to the base post 5, for example by welding. Alternatively, the base post 5 may be integrally provided with a projection (not shown) adjacent the upper ends of the base legs 6, which projection would extend radially outwardly from and around the post 5 for supporting the tray 24.

The tube 3, base post 5, base legs 6, clamping member 8, upper and lower plates 7 and 26 are preferably constructed of aluminum, and the base post 5 and base legs 6 are preferably hollow so as to reduce the overall weight of the unit 1 for easy movement thereof. However, other materials such as plastic may be utilized.

The posting unit 1 is preferably assembled as follows. The base 2 is placed on a horizontal surface and the hole 27 of the support plate 26 is fitted over the upper end of the base post 5. The support plate 26 is then slid downwardly so as to rest atop the upper ends of the base legs 6, or alternatively is welded to the base post 5. The tray 24 is then fitted onto the base post 5 by means of the tray hole 25 and slid downwardly until it rests atop the support plate 26. The posting members 4 are assembled onto the tube 3 from the lower end thereof by aligning the hole 23 of each posting member 4 with the tube 3 and sliding same along the tube 3 toward upper plate 7. The first posting member 4 assembled onto the rod 3 abuts the upper plate 7. In accordance with the invention, the posting members 4 are sized so that about 24 to 26 posting members 4 fit axially along the tube 3. After the last posting member 4 is assembled on the tube 3, the clamping member 8 is mounted onto the tube 3 by sliding same over the lower end of the tube 3 so that the tube 3 extends through the clamping member hole 9. The set screw 17 is then tightened so as to engage the lower end of the tube 3, in order to keep the clamping member 8 and posting members 4 fixed on the tube 3 during the remaining assembly steps.

The tube 3, with the posting members 4 and clamping member 8 assembled thereon, is then telescopingly slid over the base post 5 and moved downwardly until the lower end of the tube 3 rests against the bottom interior surface 28 of the tray 24.

In use, in order to adjust the position of the posting members 4 with respect to the tube 3, the set screw 17 is loosened (i.e. turned to the left) and the clamping member 8 is lowered slightly away from the posting members 4. The individual posting members 4 can now be rotated about the tube 3 with respect to one another so that the peripheral edges 22 of adjacent posting members 4 are out of alignment with one another. Messages, notices, or other information 29 can then be fastened, for example with tacks (FIG. 1) to the peripheral edges 22 of the posting members 4, and preferably to the periphery edges 22 of the posting members 4 which project further horizontally outwardly with respect to adjacent posting members 4, so that the messages 29 posted thereon hang relatively freely from the posting unit 1. In addition, messages, etc. may also be fastened to any exposed lower surfaces 21 of the posting members 4 so as to hang downwardly therefrom. It should be understood that information may also be displayed on the posting members 4 when in their aligned positions (i.e. when the peripheral edges 22 are aligned with one another).

In the assembled state, the posting unit 1 stands approximately 6 feet high. Thus, the relatively large size of the posting unit 1 enables easier viewing thereof by individuals in the work area. However, other sizes are within the scope of the invention, and smaller units can be utilized at an individual workstation, for example alongside or atop a desk.

Figure 7:
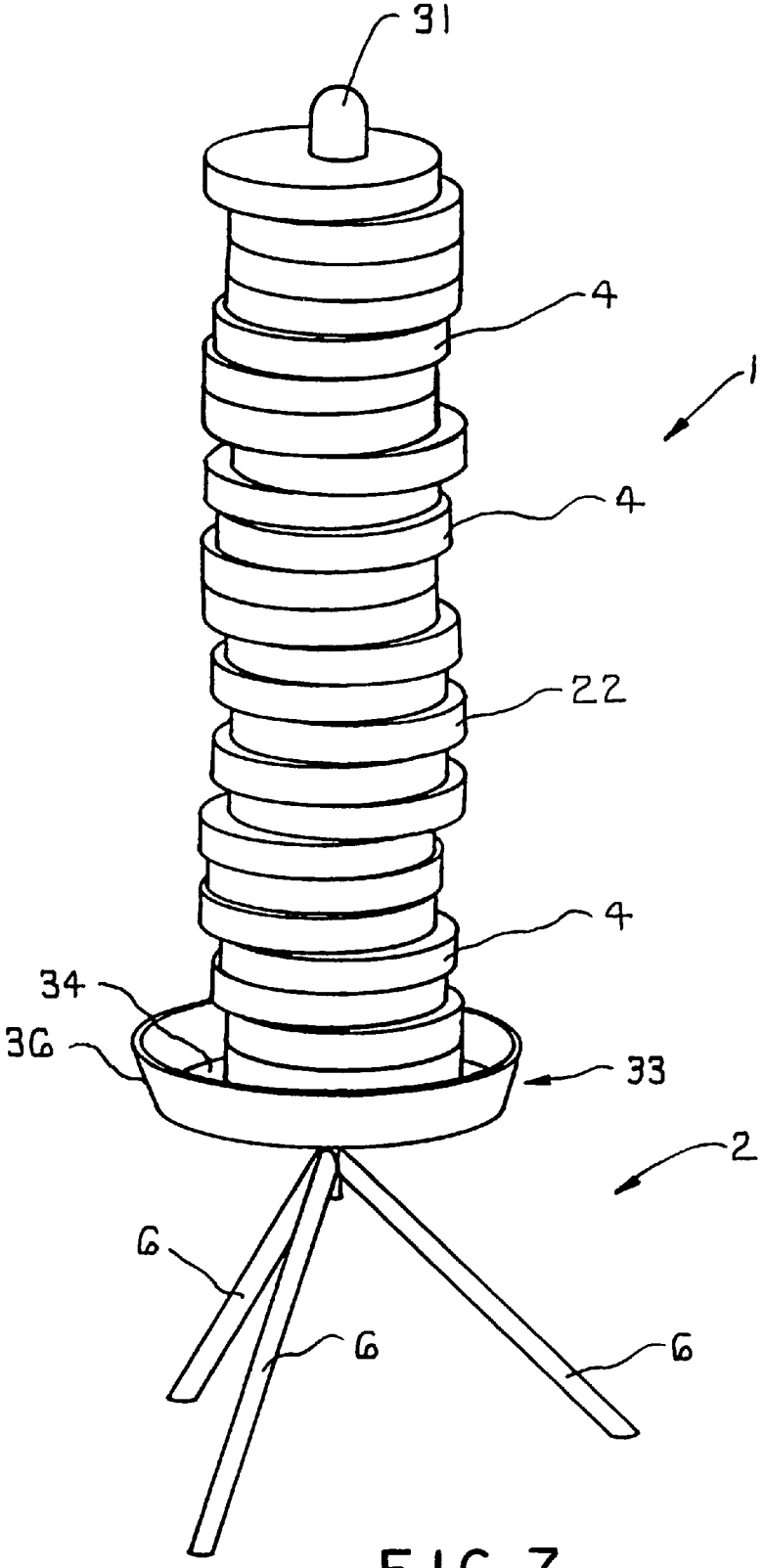
FIG. 7 is a perspective view of a second embodiment of the information posting unit.

FIGS. 7–9 show a second embodiment of the posting unit 1 which includes a different clamping arrangement for adjusting the positions of the posting members 4. Components which are identical to those discussed with regard to the embodiment shown in FIGS. 1–6 are identified with the same reference numbers.

The second embodiment of the invention includes a single rod 30 which extends upwardly from base legs 6. The rod 30 may be solid or hollow if desired, to reduce the overall weight of the posting unit 1. The posting members 4 are disposed in a stacked arrangement generally vertically along the rod 30 as in the first embodiment. The posting members 4 are held in place on rod 30 by a clamping knob 31 having a centrally disposed blind bore 32. The blind bore 32 preferably has a diameter of a size sufficient to provide a snug sliding fit of the clamping knob 31 axially along the upper end of rod 30 towards the uppermost posting member 4 in order to clamp the posting members 4 snugly against one another, and away from the uppermost posting member 4 to loosen the posting members 4 so that they can be rotated about the rod 30, if desired. Downward movement of the posting members 4 is limited by a tray 33 discussed herebelow. The knob 31 may be constructed of plastic, wood, or other lightweight materials.

The embodiment of FIGS. 7–9 also includes a round tray 33 having a flat bottom 34 with a central hole 35 disposed therein, and an upwardly extending annular side wall 36 which flares outwardly from the bottom wall 34.

The assembly of the embodiment of FIGS. 7–9 is as follows. The support plate 26 is placed over the top end of the rod 30 so that the rod 30 extends through the hole 27 thereof and the plate 26 is slid downwardly until it rests against the upper ends of the base legs 6. Alternatively, the plate 26 may be fixedly attached to the rod 30, for example by welding. The tray 33 is then placed over the top end of the rod 30 so that the rod 30 extends through the hole 35 thereof, and the tray 33 is slid downwardly until it rests atop the support plate 26. The individual posting members 4 are then assembled onto the rod 30 by aligning each of the holes 23 thereof with the top end of the rod 30 and sliding the posting members 4 downwardly along the rod 30. The lowermost posting member 4 assembled onto the rod 30 is positioned atop the tray bottom 34. The knob 31 is fitted over the top end of the rod 30. As discussed above, the knob 31 is frictionally movable axially up and down on the top end of the rod 30 in order to loosen or tighten the posting members 4 with respect to one another, respectively.

Alternatively, the bore 32 of clamping knob 31 may include threads (not shown) which engage in corresponding threads at the top end of rod 30. Thus, the axial position of the knob 31 on the rod 30 is adjusted by rotating the knob 31 with respect to the rod 30.

It should be understood that although the preferred embodiment contemplates use of the posting unit along with fasteners such as tacks, the posting members may also be utilized with self-stick notes such as Post-it brand notes which would readily adhere to the rigid foam posting members.

Further, although the preferred embodiment includes posting members constructed entirely of a rigid foam material, it is within the scope of the invention to provide a hollow posting member having only a peripheral wall of rigid foam usable with fasteners such as tacks and self-stick notes, or a peripheral wall of another material usable with self-stick notes, such as a smooth plastic.

The preferred embodiment contemplates identical disc-shaped posting members for easier assembly of the posting unit, however, it is also within the scope of the invention to provide posting members having other shapes which would permit misalignment between peripheral surfaces of adjacent posting members. For example, the posting members can have an elongate or egg-shaped configuration with a hole disposed generally centrally therein or otherwise.

Further, it would also be within the scope of the invention to provide some posting members according to the preferred embodiment, i.e. identical circular discs having an eccentric hole therein, and some posting members which are shaped differently so as to have, for example, a hole disposed centrally therein, or eccentrically therein but at a different eccentricity than the holes of the other posting members. Still further, the posting members may have different thicknesses.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A mobile, freestanding information posting unit comprising:

a base;

a rod extending upwardly from said base in a generally vertical manner;

a plurality of posting members supported one atop the other in a generally vertical stack along said rod, each said posting member defining an outer periphery having a portion constructed of a puncturable and at least partially resilient material capable of releasably gripping a fastener having a sharp end; and said portion of each said posting member being disposed to permit the posting of information thereon by means of a fastener inserted at least partially into said portion, at least one said posting member being rotatable relative to said rod into a position wherein said outer periphery thereof is offset relative to said outer periphery of an adjacent said posting member.

2. The posting unit of claim 1 wherein each said posting member comprises a generally round disc having two end faces facing away from one another, with said outer periphery adjoining said two end faces, and a hole extending therethrough transversely with respect to said end faces, said rod extending through said hole of each said disc.

3. The posting unit of claim 2 wherein said hole is disposed eccentrically with respect to said outer periphery of at least some of said discs such that said discs are rotatable about said rod into positions wherein at least some of said outer peripheries are out of alignment with respect to said outer periphery of an adjacent one of said discs.

4. The posting unit of claim 3 further including a clamping member movably mounted on said rod for clamping said discs against one another in said non-aligned positions.

5. The posting unit of claim 4 wherein said rod has a longitudinal axis and said clamping member comprises a knob disposed at a top end of said rod having a hole disposed therein, said rod projecting into said hole of said knob and said knob being axially movable along said rod in a direction away from said base to loosen said discs with respect to one another, and in a direction towards said base to tighten said discs against one another.

6. The posting unit of claim 4 wherein:

said rod has a longitudinal axis;

a stop is fixedly disposed at a top end of said rod immediately adjacent an uppermost one of said discs;

said clamping member is disposed adjacent a bottom end of said rod and has a hole disposed therein through which said rod extends, said clamping member being axially movable along said rod in a direction away from said stop to loosen said discs with respect to one another, and in a direction toward said stop to tighten said discs against one another.

7. The posting unit of claim 6 wherein said clamping member comprises a first plate-like portion having an upwardly facing planar surface disposed to support a lowermost one of said discs and a downwardly facing planar surface opposite said upwardly facing surface, and a second tubular portion projecting downwardly from said downwardly facing surface, said hole of said clamping member extending through said first plate-like portion and said second tubular portion, said second tubular portion having a threaded bore which receives a set screw for abutting against said rod and locking said clamping member axially with respect to said rod at a desired position.

8. The posting unit of claim 1 wherein each said posting member is constructed of a rigid foam.

9. The posting unit of claim 1 further comprising a tray disposed underneath a lowermost one of said posting members and about said rod, said tray having a generally upwardly opening configuration for storing objects therein.

10. The posting unit of claim 1 wherein said base includes a generally vertically extending post, and said rod has a hollow interior having an inner diameter of a size sufficient to permit telescoping engagement of said rod about said post.

11. The posting unit according to claim 10 further comprising means disposed adjacent said base for maintaining a fixed axial position of said rod on said base.

12. The posting unit according to claim 1 wherein said base comprises three legs each having an upper end disposed adjacent a bottom end of said rod and a lower end configured for engaging a generally horizontal support surface.

13. The posting unit of claim 1 wherein each said posting member defines a pair of generally horizontally oriented end faces which face away from one another with said outer periphery extending transversely between and adjoining said end faces.

14. The posting unit of claim 1 wherein said portion of said outer periphery has a smooth outer surface to permit attachment of self-stick notes directly thereto.

15. The posting unit of claim 1 wherein said one posting member is rotatable relative to said rod into a position wherein said outer periphery thereof projects horizontally outwardly beyond said outer periphery of an adjacent said posting member.

* * * * *